US011060311B2

(12) United States Patent
Begic

(10) Patent No.: US 11,060,311 B2
(45) Date of Patent: Jul. 13, 2021

(54) DEVICE AND ASSEMBLY FOR CLEANING SWIMMING POOLS

(71) Applicant: Jerko Begic, Brossard (CA)

(72) Inventor: Jerko Begic, Brossard (CA)

( * ) Notice: Subject to any disclaimer, the term of this patent is extended or adjusted under 35 U.S.C. 154(b) by 0 days.

(21) Appl. No.: 16/288,032

(22) Filed: Feb. 27, 2019

(65) Prior Publication Data

US 2019/0264458 A1 Aug. 29, 2019

Related U.S. Application Data

(60) Provisional application No. 62/635,589, filed on Feb. 27, 2018, provisional application No. 62/673,310, filed on May 18, 2018.

(51) Int. Cl.
*E04H 4/16* (2006.01)
*E04H 4/12* (2006.01)

(52) U.S. Cl.
CPC ..... *E04H 4/1645* (2013.01); *E04H 4/1272* (2013.01)

(58) Field of Classification Search
CPC ... E04H 4/1645; E04H 4/1272; E04H 4/1636; E04H 4/1618
USPC ..... 210/167.1, 167.16, 167.17, 416.2; 15/1.7
See application file for complete search history.

(56) References Cited

U.S. PATENT DOCUMENTS 4,737,279 A * 4/1988 Lewis ..... E04H 4/1272 134/167 R
5,099,535 A * 3/1992 Chauvier ..... E04H 4/1654 15/1.7
5,472,517 A * 12/1995 Laberge ..... E04H 4/1636 134/21
6,112,354 A * 9/2000 Stoltz ..... E04H 4/1663 15/1.7
6,393,628 B1 * 5/2002 Kellogg ..... E04H 4/1272 4/490
9,453,355 B1 * 9/2016 Rasp ..... E04H 4/1645
2003/0000029 A1 * 1/2003 McFarland ..... E04H 4/1636 15/1.7
2004/0158943 A1 * 8/2004 Popielarczyk ..... E04H 4/1636 15/1.7
2012/0305498 A1 * 12/2012 Palmer ..... E04H 4/1272 210/776
2017/0260766 A1 * 9/2017 Hui ..... E04H 4/1636

* cited by examiner

*Primary Examiner* — Fred Prince
(74) *Attorney, Agent, or Firm* — PRAXIS

(57) ABSTRACT

A device for cleaning a swimming pool, containing water and comprising a bottom surface thereof, comprises a vacuum head defining a sweeping side, an inlet port, an outlet port and an internal cavity in fluid communication with the inlet and outlet ports. The sweeping side provides for being swept along the bottom surface of the swimming pool and defines an opening leading to the internal cavity. The outlet port provides for being in fluid communication with a vacuum for subjecting the internal cavity to a vacuum force for suctioning water and debris. The inlet port provides for being in fluid communication with a water source for injecting water into the inner cavity during suctioning. The vacuum force via the outlet port in tandem with water injection via the inlet port provides for the vacuum head to suction water and debris via the opening for discharge via the outlet port.

15 Claims, 13 Drawing Sheets

DEVICE AND ASSEMBLY FOR CLEANING SWIMMING POOLS

CROSS-REFERENCE TO RELATED APPLICATIONS

The present application claims priority on U.S. Provisional Patent Application No. 62/635,589 filed on Feb. 27, 2018 and on U.S. Provisional Patent Application No. 62/673,310 filed on May 18, 2018, both of which are incorporated by reference herein in their entirety.

TECHNICAL FIELD

The present disclosure generally relates to swimming pool sanitation. More particularly but not exclusively the present disclosure relates to a device and assembly for cleaning swimming pools.

BACKGROUND

Conventional leaf catchers for swimming pools include a vacuuming sweeping/suctioning head with a handle rod for maneuvering the head at or near the bottom of the swimming pool. The head comprises a tube for being connected to a water hose that is connected to a pump. The pump suctions the water via the head thereby suctioning leaves into the mount of the head. The top of the head is open, and net or bag is placed on top to catch the leaves. The sweeping head is connected to a skimmer via a hose which in turn is connected to the pump via another hose. During cleaning, the user may often have to clean the skimmer. Accordingly, the user must shut down the pump and remove the hose from the skimmer to access it for cleaning. The user also needs to shut down the pump so that the removed hose does not continue suctioning.

OBJECTS

An object of the present disclosure is to provide a device for cleaning a swimming pool.

An object of the present disclosure is to provide an assembly for cleaning a swimming pool.

An object of the present disclosure is to provide a method for cleaning a swimming pool.

SUMMARY

In accordance with an aspect of the present disclosure, there is provided a device for cleaning a swimming pool, the swimming pool containing water and comprising a bottom surface thereof, the device comprising: a vacuum head defining a sweeping side, an inlet port, an outlet port and an internal cavity in fluid communication with the inlet and outlet ports, the sweeping side providing for being swept along the bottom surface of the swimming pool and defining an opening leading to the internal cavity, the outlet port providing for being in fluid communication with a vacuum for subjecting the internal cavity to a vacuum force for suctioning water and debris, the inlet port providing for being in fluid communication with a water source for injecting water into the inner cavity during suctioning, wherein the vacuum force via the outlet port in tandem with water injection via the inlet port provides for the vacuum head to suction water and debris via the opening for discharge via the outlet port.

In an embodiment, the device further comprises a handle mounted to the vacuum head for maneuvering the vacuum head along the bottom surface of the swimming pool.

In an embodiment, the vacuum head comprises a conduit circumscribing the internal cavity and being in fluid communication with the inlet port, the conduit defining openings for injecting water received from the water source via the inlet port into the cavity. In an embodiment, the openings are defined by water injection elements connected to the conduit. the water injection elements are selected form the group consisting of nozzles and jets.

In an embodiment, the vacuum head comprises a bottom plate defining the inlet port and comprising the conduit and an upper plate defining the outlet port. In an embodiment, the upper plate is mounted to the bottom plate. In an embodiment, the upper plate is removable from the bottom plate.

In an embodiment, the device further comprises a suction hose for being connected to the outlet port and to a skimmer in fluid communication with the vacuum. In an embodiment, the device further comprises vacuum plate for being connect to the suction hose and to the skimmer. In an embodiment, the vacuum plate comprises a port for being connected to the suction hose and a release valve for being selectively opened and closed. In an embodiment, the device further comprises at least one cap member for closing an open end of the suction hose when removed from the skimmer or from the vacuum head.

In an embodiment, the device further comprises a water hose for being connected to inlet port of the vacuum head and to the water source.

In an accordance with an aspect of the present disclosure there is provided an assembly for cleaning a swimming pool comprising: a device for cleaning a swimming pool according any one of the above paragraphs; and a skimmer assembly in fluid communication with the vacuum head via the outlet port and with the vacuum for being subjected to the vacuum force, wherein the vacuum force via the outlet port in tandem with water injection via the inlet port provides for the vacuum head to suction water and debris via the opening for discharge via the outlet port and into the skimmer assembly.

In an embodiment, the skimmer assembly is selected from the group consisting of an in-ground pool skimmer, an out-pool skimmer, two in-ground pool skimmers, two out-pool skimmers, an in-ground pool skimmer connected to an out-pool skimmer and any combination thereof.

In accordance with an aspect of the present disclosure, there is provided a device for cleaning a swimming pool, the swimming pool containing water and comprising a bottom surface thereof, the device comprising: a upper plate for being mounted to a vacuum head defining a sweeping side, an inlet port, and an internal cavity in fluid communication with the inlet port, the sweeping side providing for being swept along the bottom surface of the swimming pool and defining an opening leading to the internal cavity, the upper plate defining an outlet port providing for being in fluid communication with a vacuum and with the internal cavity for subjecting the internal cavity to a vacuum force for suctioning water and debris from the bottom surface, the inlet port providing for being in fluid communication with a water source for injecting water into the inner cavity during suctioning, wherein the vacuum force via the outlet port in tandem with water injection via the inlet port provides for the vacuum head to suction water and debris via the opening for discharge via the outlet port.

In accordance with an aspect of the present disclosure, there is provided a device for cleaning a swimming pool, the swimming pool containing water and comprising a bottom surface thereof, the device comprising: a bottom plate for being mounted to a vacuum head defining an outlet portion, the bottom plate defining a sweeping side, an inlet port, and an internal cavity in fluid communication with the inlet port and for being placed in fluid communication with the outlet port, the sweeping side providing for being swept along the bottom surface of the swimming pool and defining an opening leading to the internal cavity, the outlet port providing for being in fluid communication with a vacuum for subjecting the internal cavity to a vacuum force for suctioning water and debris, the inlet port providing for being in fluid communication with a water source for injecting water into the inner cavity during suctioning, wherein the vacuum force via the outlet port in tandem with water injection via the inlet port provides for the vacuum head to suction water and debris via the opening for discharge via the outlet port.

In accordance with an aspect of the present disclosure, there is provided a method for cleaning a swimming pool, the method comprising: placing a suction within pool water; subjecting the suction to a vacuum force; supplying the suction with water pressure in tandem with vacuum force, whereby the vacuum force and the water pressure provides for suction of water and debris therein; and discharging the water and debris from the suction.

In accordance with an aspect of the present disclosure, there is provided a vacuum plate for a skimmer of a swimming pool, the skimmer being in fluid communication with a vacuum for subjecting the skimmer to a vacuum force, the vacuum plate comprising: a body for being mounted to the skimmer, the body defining an inlet port for being in fluid communication with a suction for suctioning water and debris from the swimming pool, the body defines a release valve for being selectively open to release vacuum pressure from the skimmer in order to decrease the vacuum force when removing the body from the skimmer.

The device for cleaning a swimming pool provides for using suctioning or vacuuming force in tandem with injection of water to facilitate and speed up the rate of suctioning or vacuuming water and debris such as leaves, and other material usually found in swimming pools that require cleaning.

The hoses with caps provided herein provide the user with the ability to empty out the skimmers during the cleaning process without shutting off the pump and the restarting it, thus cutting down work time and effort.

The vacuum plates with valves allow for easer removal thereof from the skimmer the cleaning process without shutting off the pump and the restarting it, thus cutting down work time and effort.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated and in accordance with an embodiment, there is provided a device for cleaning a swimming pool containing water and comprising a bottom surface thereof. The device comprises a vacuum head defining a sweeping side, an inlet port, an outlet port and an internal cavity in fluid communication with the inlet and outlet ports. The sweeping side provides for being swept along the bottom surface of the swimming pool and defines an opening leading to the internal cavity. The outlet port provides for being in fluid communication with a vacuum for subjecting the internal cavity to a vacuum force for suctioning water and debris. The inlet port provides for being in fluid communication with a water source for injecting water into the inner cavity during suctioning. The vacuum force via the outlet port in tandem with water injection via the inlet port provides for the vacuum head to suction water and debris via the opening for discharge via the outlet port.

Figure 1:
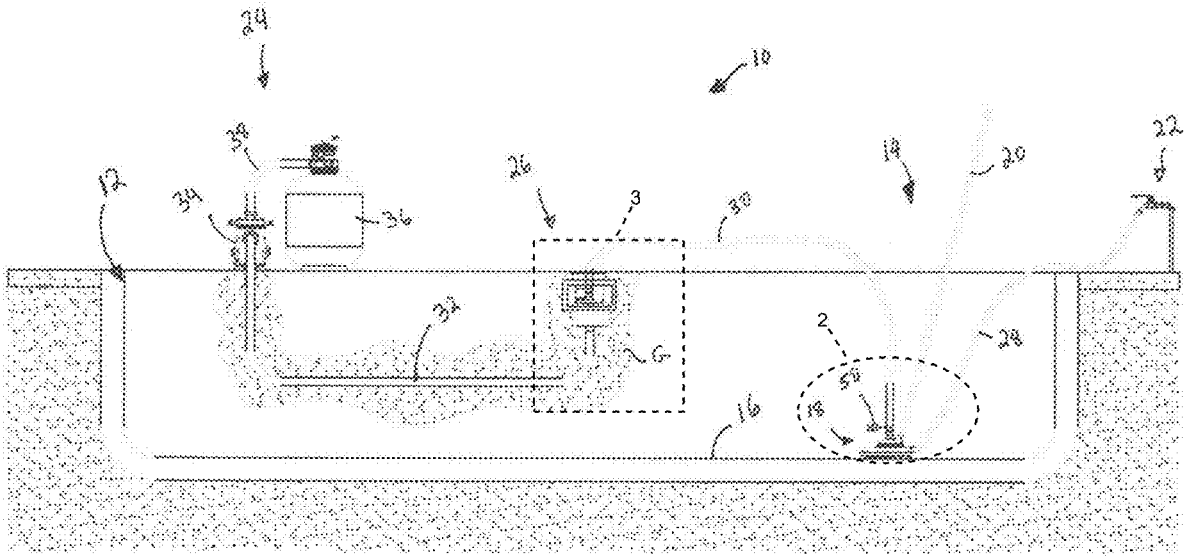
FIG. 1 is a schematic representation of the assembly for cleaning swimming pools in accordance with a non-limiting illustrative embodiment of the present disclosure.

FIG. 1 shows an assembly 10 for cleaning swimming pools, more specifically for removing leaves and other debris from a swimming pool 12.

Figure 2:
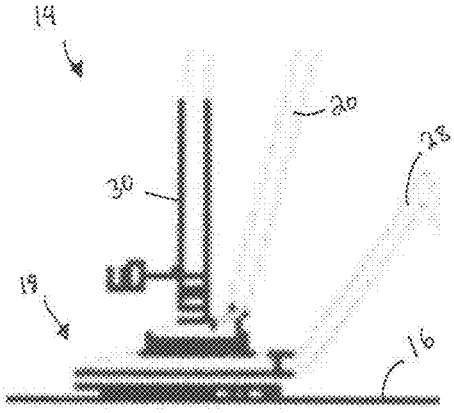
FIG. 2 is an enlarged view of portion 2 of FIG. 1.

As shown in FIGS. 1 and 2, the assembly 10 includes a vacuuming device 14 for cleaning swimming pools 12 also knows as a leaf/debris catcher device; the device 14 is used to sweep and suction a bottom surface 16 of the swimming pool 12. The device 14 includes a vacuum head device 18 that is maneuvered along the bottom surface 16 by way of a handheld sweeping rod 20. Accordingly, the vacuum head 18 may be weighted to sink to the bottom surface 16 of the pool 12 for sweeping and suctioning.

As shown in FIG. 1, the vacuum head 18 is in fluid communication with a vacuum 24. A skimmer 26 is interposed between the vacuum head 18 and the vacuum 24 and is in fluid communication with both the vacuum head 18 and the vacuum 24. The vacuum 24 provides a vacuum force providing the vacuum head 18 to suction leaves and debris from the bottom surface 16 and providing for the skimmer 26 to receive the leaves and debris suctioned by the vacuum head 18. The vacuum head 18 is also in fluid communication with a water source 22 such as a backyard water faucet for example which provides water to the vacuum head 18.

With reference to FIGS. 1 and 2, the vacuum head is fluid communication with the water source 22 via hose 28, which is a water hose, and with the skimmer 24 via hose 30, which is a suction hose.

Figure 3:
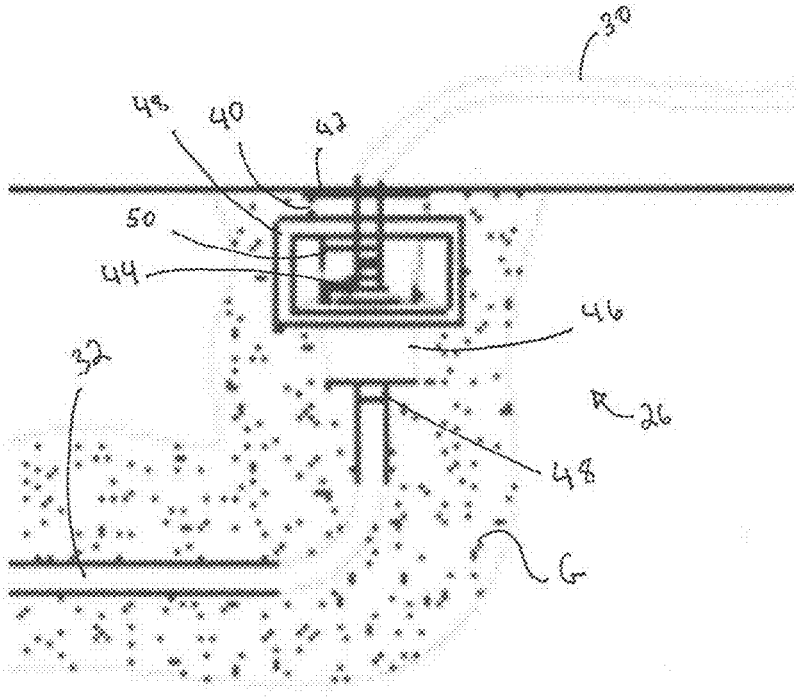
FIG. 3 is an enlarged view of portion 3 of FIG. 2.
Figure 4:
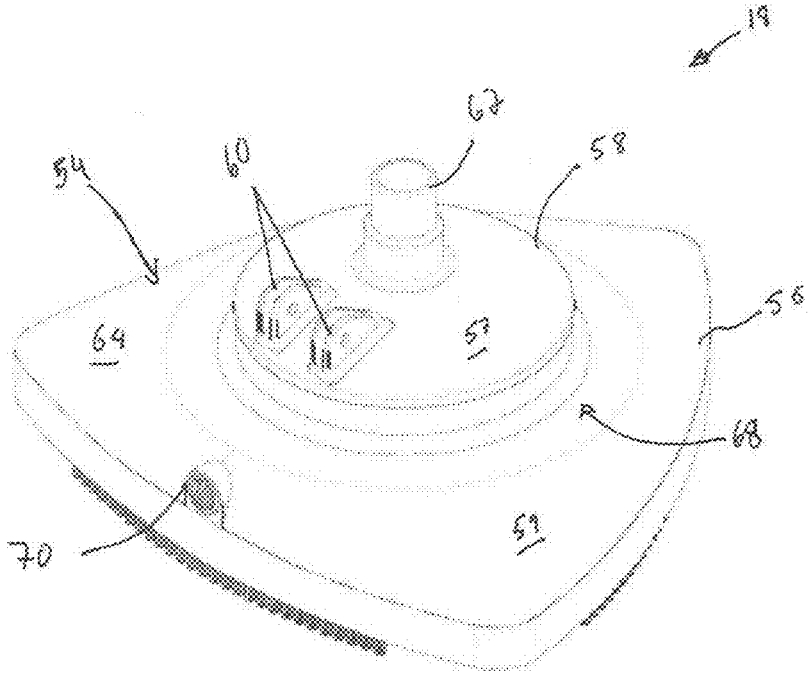
FIG. 4 is rear, top perspective view of a vacuum head of the assembly of FIG. 1 in accordance with a non-limiting illustrative embodiment of the present disclosure.
Figure 5:
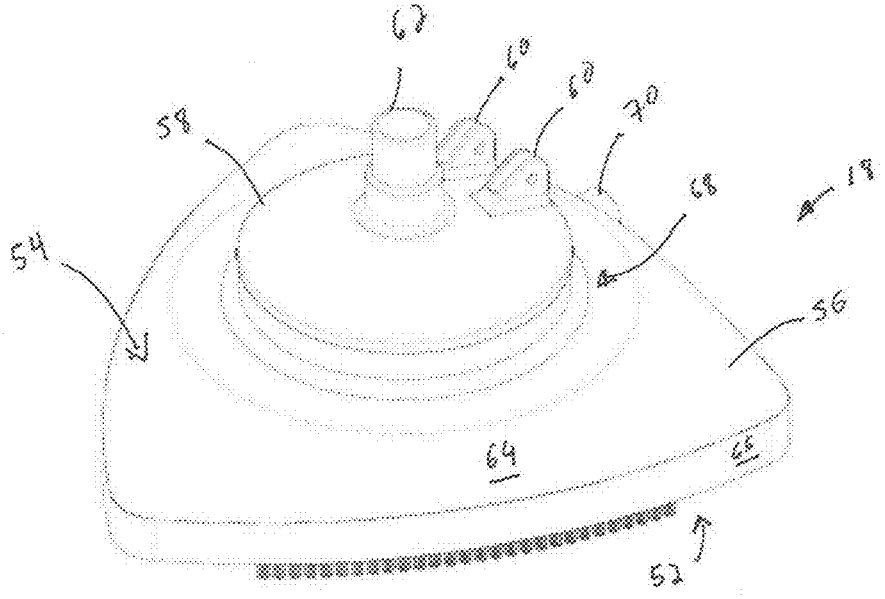
FIG. 5 is a rear, top perspective view of the vacuum head of FIG. 4.
Figure 6:
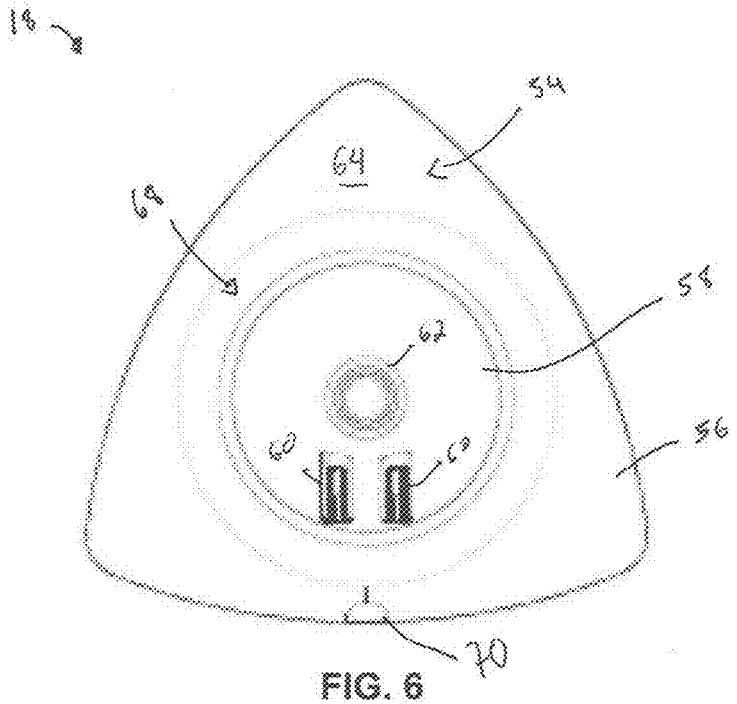
FIG. 6 is a top plan view of the vacuum head of FIG. 4.
Figure 7:
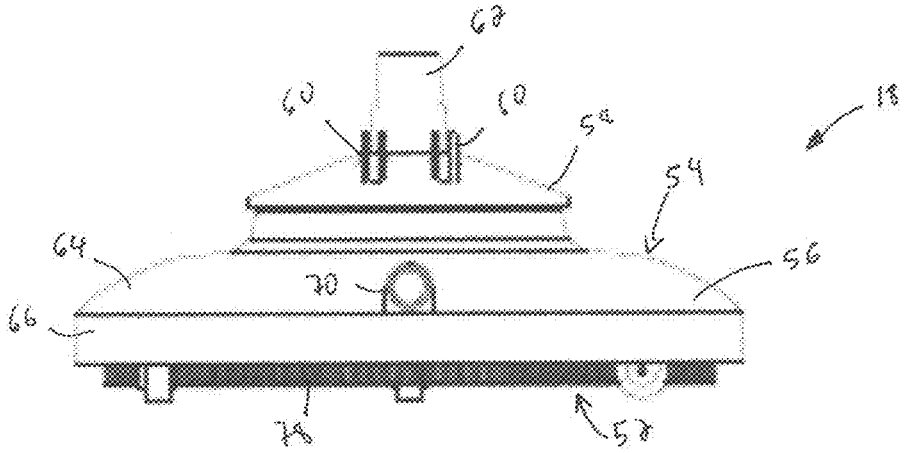
FIG. 7 is a rear view of the vacuum head of FIG. 4.

As shown in FIGS. 1 and 3, the skimmer 24 is in fluid communication with the vacuum 24 via hose 32.

With reference to FIGS. 1 and 2, the vacuum head is fluid communication with the water source 22 via hose 28, which is a water hose, and with the skimmer 26 via hose 30, which is a suction hose.

As shown in FIGS. 1 and 3, the skimmer 26 is in fluid communication with the vacuum 24 via hose 32.

Referring to FIG. 1 and as is known in the art, the vacuum 24 includes a pump 34 in communication with a filter 36, such as a sand filter via hose 38. The skimmer 26 is connected to the pump via the hose 32.

Pool systems which include skimmer, pump and filter assemblies, including pool heaters and water closed circuit conduits for recirculating water through the circuit for filtering as well as heating are well known in the art and need not be described in detail herein.

Turning back to FIGS. 1 and 3, the skimmer 26, in this example is an in-ground G skimmer 26 and includes a main body 40 having top openable enclosure such as a lid thereby defining a top opening 42 positioned next to the pool 12 allowing the users to access the internal contents of the skimmer 26. The hose 30 enters the skimmer 26 via the top opening 42 to be connected to a vacuum plate 44 which in turn is positioned on top of a skimmer basket 46 which includes a filter. The skimmer 26 includes in an in-pool lateral entry opening 48 for water entry as is known in the art. The skimmer basket 46 includes a bottom outlet port 48 which is connected to the hose 32.

As shown in FIGS. 2 and 3, the hose 30 includes caps 50 attached near each end opening thereof for closing the hose 32 when removed from either one of the skimmer 26 or the vacuum head 18.

With reference to FIGS. 4 to 9, the vacuum head 18 with be further described in accordance with a non-restrictive illustrative embodiment thereof.

The vacuum head 18 defines a sweeping side 52 and a non-sweeping side 54.

More specifically and with reference to FIGS. 4 to 7, the vacuum head 18 includes a bottom plate 56 defining the sweeping side 52. An upper plate 58 is mounted to the bottom plate 56. The respective outer surfaces 57 and 59 of the bottom plate 56 and upper plate 58, respectively, generally define the non-sweeping side 54.

The upper plate 58 has a generally circular configuration and includes brackets 60 for pivotally receiving the handheld sweeping rod 20 as well a central upwardly protruding top port 62 for being connected to hose 30.

The bottom plate 56 has a triangular configuration. The outer surface 57 thereof defines a top face 64 and a lateral wall 66 downwardly extending therefrom. A central portion 68 is defined at the top face 64 for receiving the upper plate 58. The bottom plate also includes a lateral port 70, laterally extending from its top face 64 for being connected to the hose 28.

Figure 8:
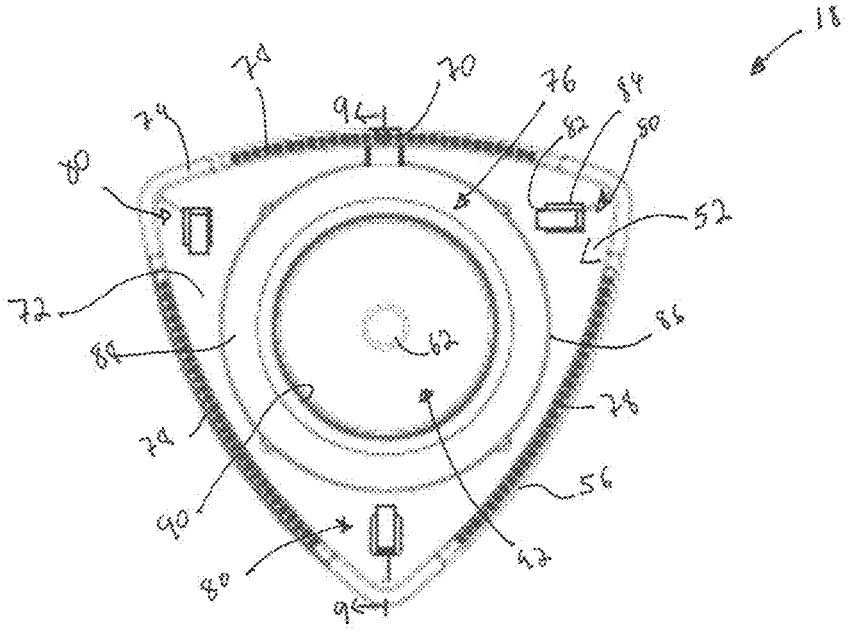
FIG. 8 is a bottom view of the vacuum head of FIG. 4.
Figure 9:
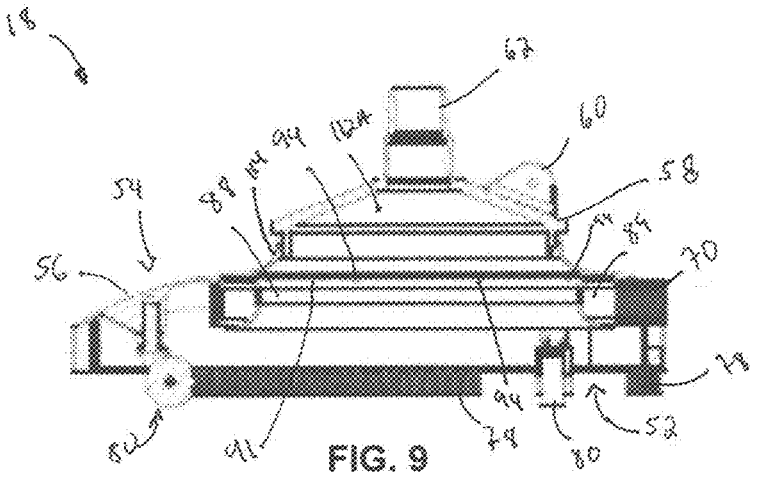
FIG. 9 is a sectional view of the vacuum head of FIG. 8 taken along line 9-9 thereof.

Turning to FIGS. 8 and 9, the sweeping side 52 of the bottom plate 56 includes a bottom face 72 defined by a panel further defining a peripheral bottom edge 74 and a central portion 76. The peripheral bottom edge 74 is contiguous with the lateral wall 66 and includes sweeping brushes 78 extending therefrom for sweeping the bottom pool surface 16. Swivel caster wheels 80 are mounted to the bottom face 72 and include rollers 82 mounted to swivel supports 84 which extend from the bottom face 72.

Figure 10:
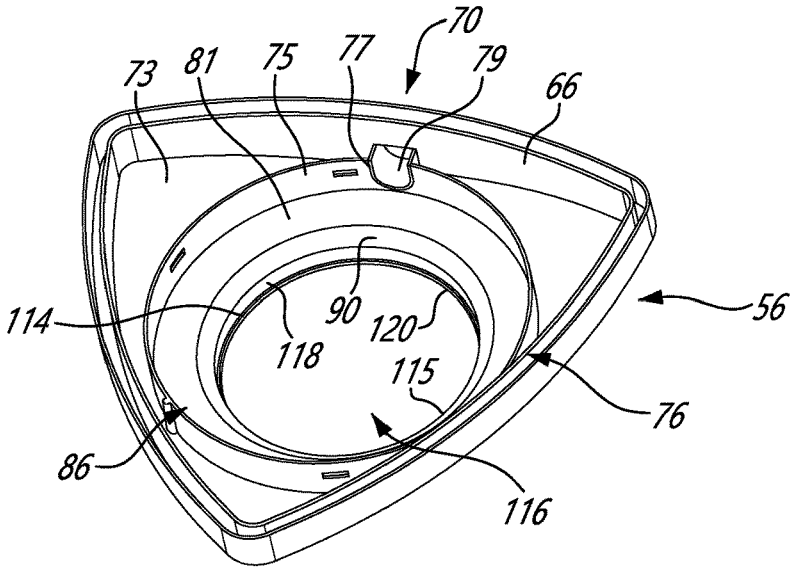
FIG. 10 is a top, front perspective view of a part of the bottom plate of the vacuum head of FIG. 4 in accordance with a non-limiting illustrative embodiment of the present disclosure.

FIG. 10 shows the bottom plate 56 disassembled from the upper plate 58 and without the panel 72 which defines the bottom face. The bottom plate 56 thus comprises an inner wall 73 from which a circular rim 75 protrudes. The circular rim 75 includes a recessed portion 77 that is contiguous with a tunnel 79 formed though a lateral wall 66 and forming part of the lateral port 70.

With reference to FIGS. 8, 9 and 10, the central portion 76 includes a circular cavity 86 defined by the circular rim 76 and a portion 81 of the inner wall 73 circumscribed thereby for receiving a conduit such as circular tube 88 that is contiguous with the lateral port 70 for receiving water therein. The tube 88 may include a lateral connector 89 for being connected to the hose 28 and thus forming part of the port 70. The circular tube 88 circumscribes a suction opening 90 that leads into a suction cavity 92 defined by the bottom plate 56 and the upper plate 58. The circular tube 88 defines a plurality of openings 94 facing the opening 90 and cavity 92. The openings 94 are positioned towards the top part 95 of the tube 88 for upwardly injecting water into the cavity 92.

Figure 11:
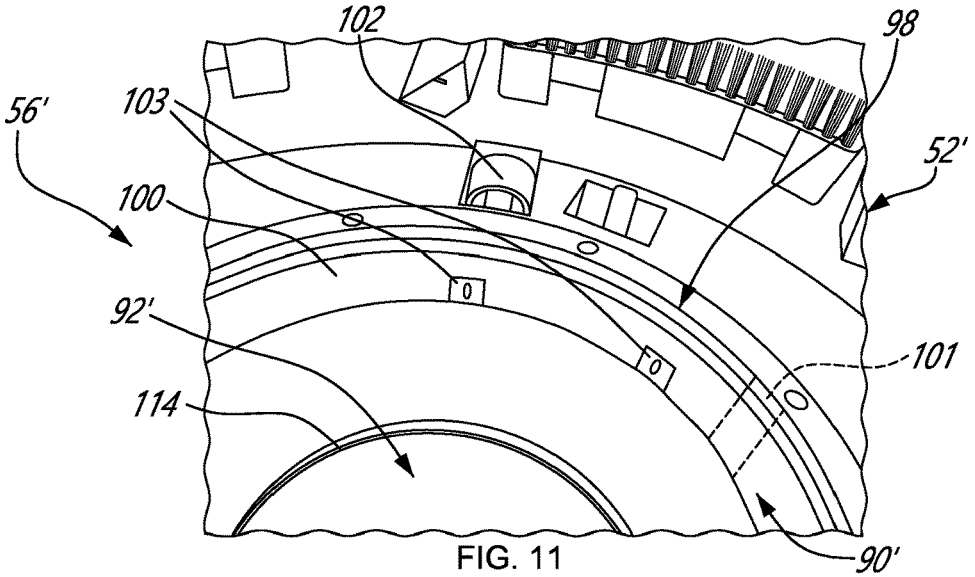
FIG. 11 is top perspective view of a portion of a vacuum head in accordance with another non-restrictive illustrative embodiment of the present disclosure.

Turning now to FIG. 11, there is shown a sweeping side 52' of a bottom plate 56' in accordance with another embodiment of the present disclosure. In this non-limiting example, the bottom plate 56' does not include a separate tube 88 but rather a molded circular conduit portion 98. In another embodiment, the conduit portion 98 is formed by mounting a circular cap 100 to a recessed inner wall section. The bottom plate 56' defines an inner vertical wall portion 101 that circumscribed the central suction opening 90'. A lateral conduit 102 is contiguous with the circular conduit portion 98 and forms part of the port 70 described herein and is connectable to the hose 28 to provide for water to enter the circular conduit portion 98. The circular conduit portion 98 defines a plurality of apertures 103 for water to be injected therefrom towards the opening 90'. In an embodiment, water injection elements such as nozzles or jets are positioned at apertures 103 for spraying water towards the opening 90'. In embodiment, water is upwardly sprayed by the nozzles or jets into the cavity 92'.

With reference to 13 to 16, the upper plate 56 is shown as a separate body that is can be mounted to a variety of bottom plates of varying configurations. The upper plate 56 comprises a circular conical top body 104 with the top port 62 extending therefrom. The conical top body 104 defines an outer edge 106, a skirt 108 downwardly extending from the conical body 104 and inwardly positioned relative to the outer 106 thereby forming a shoulder 107. The skirt 108 includes thread elements 110. The upper plate 56 is hollow and thus the conical body 104 defines an upper conical cavity portion 112A contiguous with a lower cavity portion 112B defined by the skirt 108.

Figure 12:
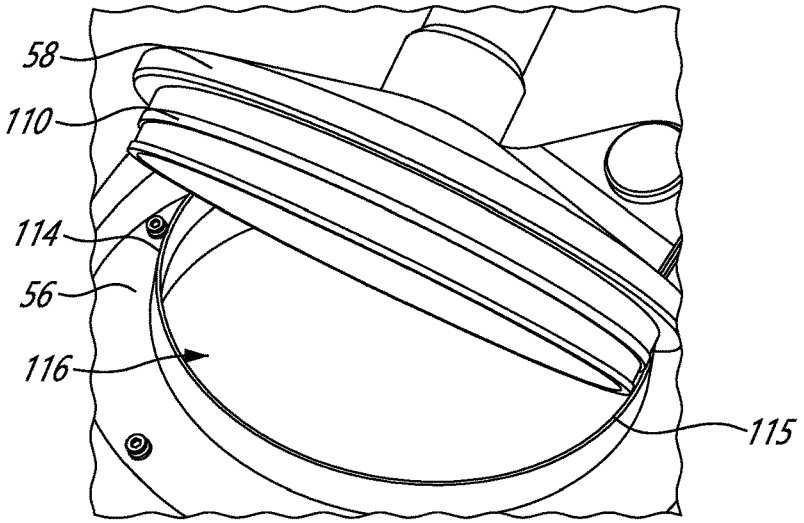
FIG. 12 is a front perspective view the upper plate and the bottom plate of the vacuum head of FIG. 14 in accordance with a non-restrictive illustrative embodiment of the present disclosure.
Figure 13:
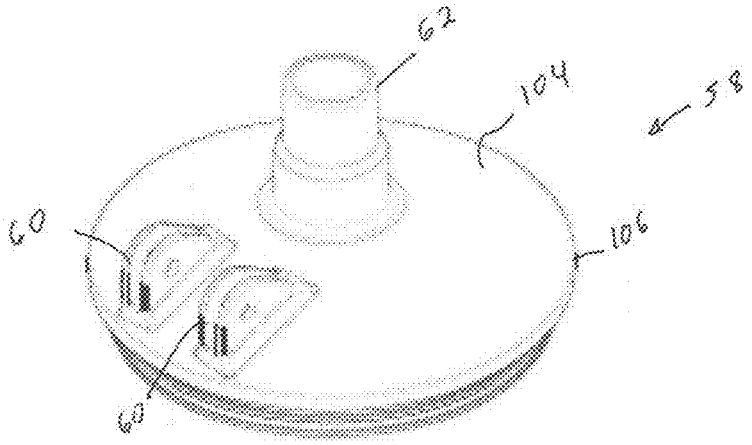
FIG. 13 is rear, top perspective view of the upper plate of FIG. 4 in accordance with a non-restrictive illustrative embodiment of the present disclosure.
Figure 14:
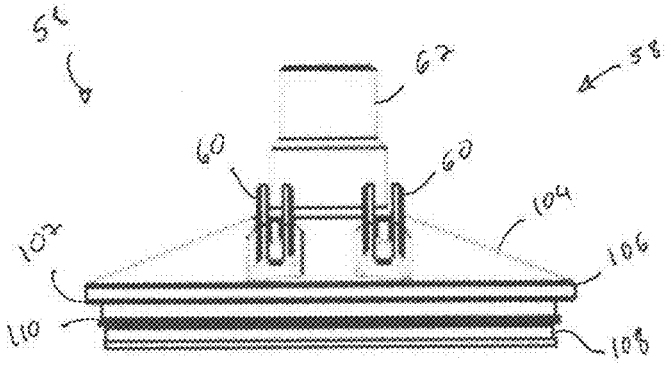
FIG. 14 is rear view of the upper plate of FIG. 13.
Figure 15:
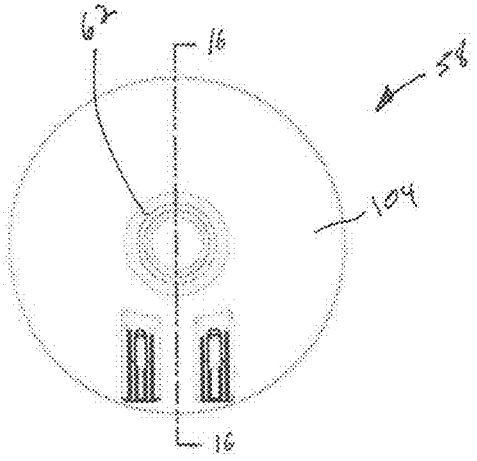
FIG. 15 is top plan view of the upper plate of FIG. 13.
Figure 16:
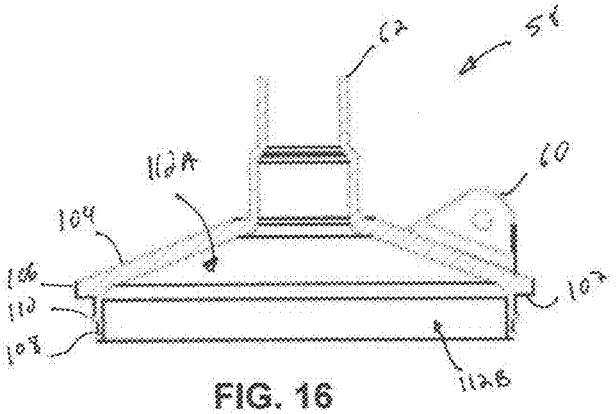
FIG. 16 is a sectional view of the upper plate of FIG. 15 taken along line 16-16 thereof.
Figure 17:
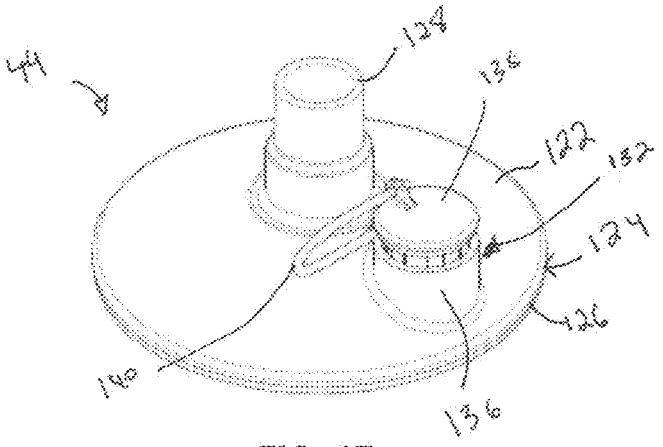
FIG. 17 is top perspective view of a vacuum plate of the assembly of FIG. 1 in accordance with a non-limiting illustrative embodiment of the present disclosure.
Figure 18:
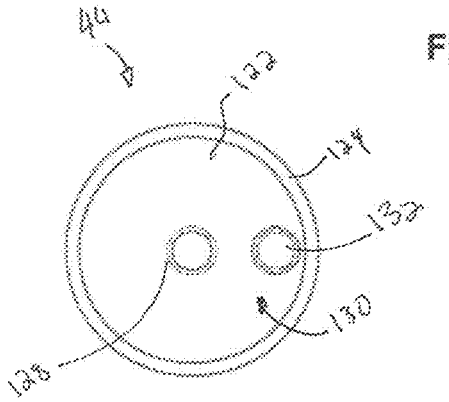
FIG. 18 is a bottom view of the vacuum plate of FIG. 17.
Figure 19:
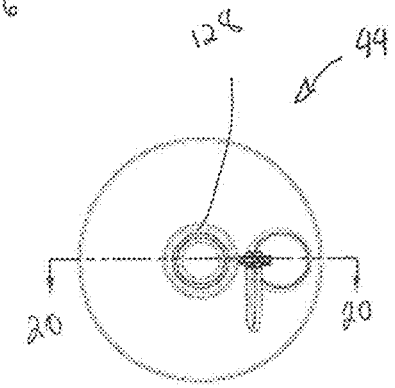
FIG. 19 is a top plan view of the vacuum plate of FIG. 17.
Figure 20:
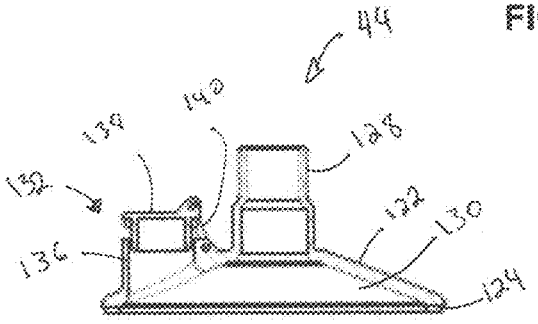
FIG. 20 is a sectional view of the upper plate of FIG. 19 taken along line 20-20 thereof.

Turning now 9 and 10, the central portion 68 of the bottom plate 56 includes an upper spout section 114 formed at its top face 64 and defining a top rim 115 (see also FIG. 12) circumscribing an opening 116 (see also FIG. 12) for receiving the skirt 108 therein. The upper spout section 114 defines an inner wall 118 that also includes thread elements 120 for a mutual interference snap fit with thread elements 110. As shown in FIG. 12 the upper plate 58 is snap fitted into the bottom plate 56. In another embodiment, the upper plate 58 and bottom plate 56 have helical threads for a screw type fit. In still another embodiment, the upper and bottom plates, 58 and 56, respectively are glued or fastened together or molded together. The bottom plate 56 defines a cavity portion 91 that is contiguous with the upper 58 cavity portion 112A when assembled, thus cavity portions 91 and 112A define the vacuum head cavity 92 and the opening 90 thereof defines the vacuum head mouth.

In operation, the pump 34 creates a vacuum within the circuit defined by the vacuum head 18, the skimmer 26 and the hoses 30 and 32. Thus the vacuum force provides the vacuum head 18 to suction leaves and debris along with water via the opening 90 into its cavity 92 though the hose 30 into the skimmer 26. The leaves and debris from hose 30 are discharged into the skimmer basket 46 via the vacuum plate 44. The skimmer basket 46 contains a filter for filtering the water exiting therethrough via the outlet port 48 into hose 32, thereby trapping the leaves and debris in the skimmer basket 46. Filtered water entering hose 32 is pumped for further filtering into the sand filter 36 and then discharged into the sewage system. During suctioning of the vacuum head 18, the water source 28 provides water to the conduit of the vacuum head 18, namely the tube 88 (or the circular conduit 98) for pressurized water to be injected via opening 94 (or openings 103 or nozzles or jets) into the cavity 92 further pushing the debris and leaves at the mouth (i.e. the opening 90) of head 98 into the cavity 92 and speeding up the suctioning process.

The vacuum force along with the water pressure provides which are both provided at vacuum head 18 provide for suctioning water, leaves and debris at a faster rate and greater volume thereby minimizing the pool cleaning process time.

Turning now to FIGS. 17-20, there is shown in a vacuum plate 44 for the skimmer 26. The vacuum plate 44 is mounted to the top of the skimmer basket 46 as shown in FIG. 3. The vacuum plate 44 includes a conical body 122 which is aligned with a corresponding opening in the skimmer basket 46 for being mounted thereto in order to seal the opening. Accordingly, the vacuum plate 44 includes a mounting periphery 124 downwardly extending from the main body 122 including threads 126 for being mounted to a corresponding spout of the skimmer basket as is known in the art.

The main body 122 includes a central inlet port 128 for being connected to hose 30 to receiving water with leaves and debris therefrom that were suctioned by the vacuum head 18. The water is released into the conical cavity 130 formed by the conical main body 122 and into the skimmer basket 46.

During cleaning of the pool, the user would have to shut down the pump 34 in order to empty out the skimmer basket 46; the reason being that the vacuum force of the pump 32 within the skimmer basket 46 via the hose 30, makes it extremely difficult to remove the vacuum plate 44 as the vacuum force suctions the plate 44 on to the skimmer basket 46. This is avoided as vacuum plate 44 includes a release valve 132 in the form of a short tube 136 eccentrically positioned on the main body 122, adjacent the central intake port 128 near the periphery 126. The tube 136 is sealed via a cap 138. Removing the cap 138 releases vacuum pressure, thus allowing the user to remove the hose 30 along with vacuum plate 44 in order to access the inside of the skimmer basket 46 without having to shut down pump 34. The cap 138 is connected to the tube 136 via a wire 140, so that the user can remove the cap 138 without the need of placing it anywhere or the danger of losing it. As such, during operation, the user can easily clean out the skimmer basket 46 without the need of going back to the pump to stop and then to restart, this further speeding up the pool cleaning process.

As is known in the art, the skimmer basket 46 also includes a smaller particle net in order to catch more leaves and debris.

Figure 21:
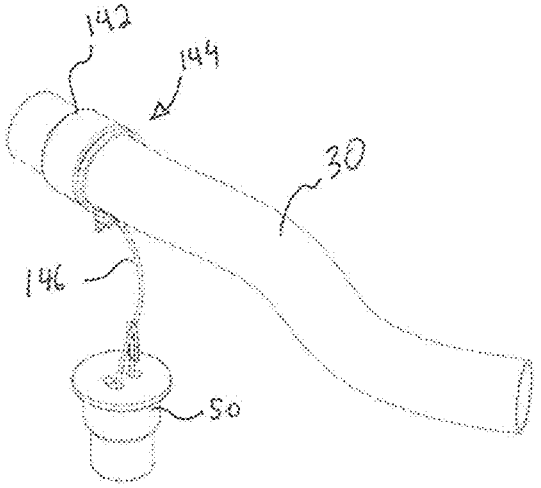
FIG. 21 is a perspective view of a portion of the suction hose of the assembly of FIG. 1 in accordance with a non-limiting illustrative embodiment of the present disclosure.

Turning now to FIG. 21 and with reference to FIGS. 1 to 3, the hose 30 includes a connector 142 at either open end 144 thereof. A cap 50 is attached to each connector 142 via a wire 146. In another embodiment only one of the open ends 144 includes the cap 50. When the hose 30 is removed from the vacuum plate 44, the user would have to shut down the pump 34 in order to avoid the vacuum force within the skimmer 26 to continue suctioning water from the hose 30 as it remains submerged in the water and the skimmer 26 during cleaning of the skimmer basket 46. The user would also have to turn the pump 34 off when removing the hose 30 from the vacuum head 18 as it would remain floating in the pool 12 to continue suctioning water. Therefore, instead of shutting the pump 34, the user would only have to plug the open end 144 by capping the connector 142 with cap 50. When the cap 50 is removed it remains attached to the connector 142 via the wire and thus conveniently positioned for use.

Figure 22:
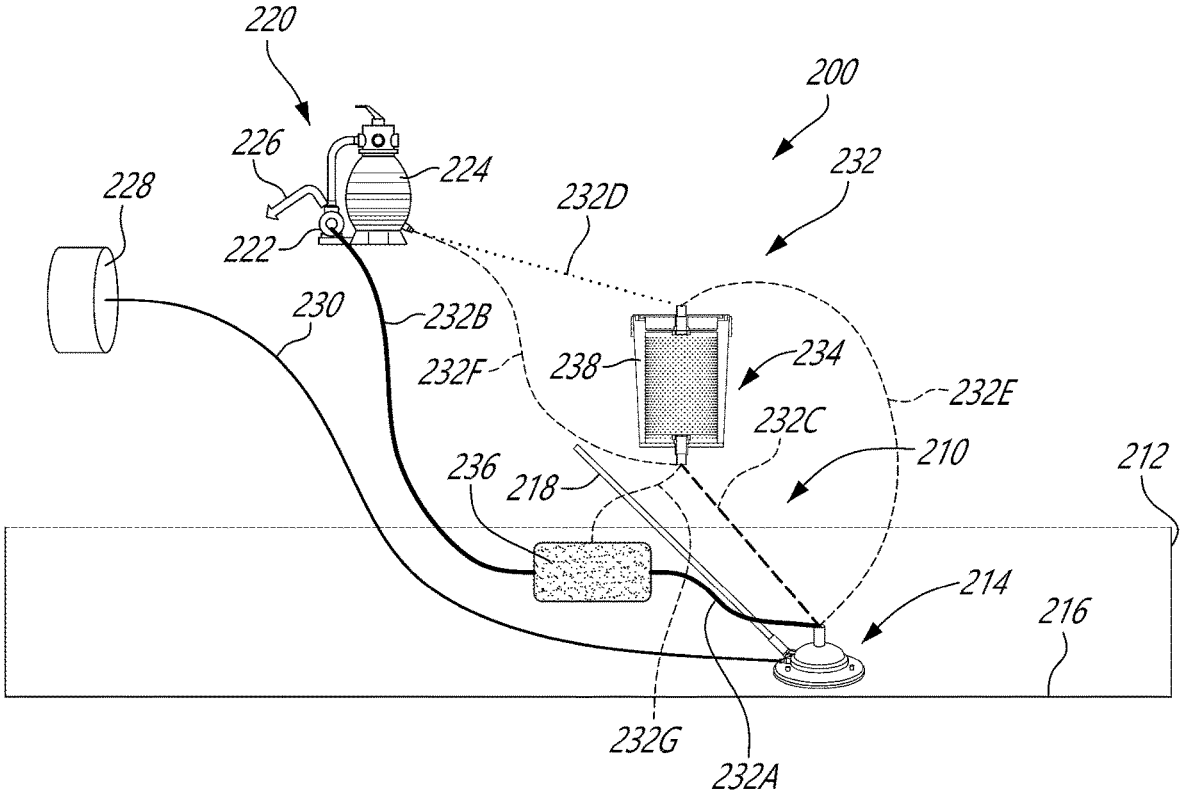
FIG. 22 is a schematic representation of an assembly cleaning a swimming pool in accordance with another non-restrictive illustrative embodiment of the present disclosure.

FIG. 22 shows an assembly 200 for cleaning swimming pools in accordance with a non-limiting illustrative embodiment of the present disclosure. Cleaning pools herein includes removing leaves and other debris from a swimming pool 212.

The system 200 includes a vacuuming device 210 for suctioning debris and leaves from the bottom surface 216 of the swimming pool 12. The vacuuming device 210 includes a vacuum head device 214 that is used to suctioningly sweep the bottom surface 216 of the swimming pool 12. The vacuum head device 14 is maneuvered along the bottom surface 216 by way of a handheld rod 218. The vacuum head device 212 is in fluid communication with a vacuum 220 such as a pump. The pump 220 may a single device or comprise an assembly including a pump unit 222 and a filter 224 such as a sand filter. The pump 220 includes an outlet conduit 226 for discarding pool water into sewage.

The vacuum head device 214 is in fluid communication with a water source 228 via a conduit 230 for providing water to the vacuum head device 214.

The vacuum head device 214 is in fluid communication with the vacuum 220 via a conduit assembly 232 which includes a skimmer assembly 234. The skimmer assembly 234 may comprise an in-ground pool skimmer 236 or an out-pool skimmer 238 or both. The conduit assembly 234 may be connected directly to a pump unit 222 or to a filter 224 for example.

The conduit assembly 32 may comprise a plurality of various conduit connections via the skimmer assembly 34 to the vacuum 20. In an embodiment, the device 214 is in fluid communication with an in-ground pool skimmer 236 via conduit 232A, the in-ground pool skimmer 236 is in fluid communication with the vacuum 220 via conduit 232B. In an embodiment, the device 214 is in fluid communication with an out-pool skimmer 236 via conduit 232C connected to a bottom end of skimmer 236 and the out-pool skimmer 236 is in fluid communication with the vacuum 220 via conduit 232D connected to a top end of skimmer 236. In an embodiment, the device 214 is in fluid communication with the out-pool skimmer 236 via conduit 232E connected to the top end of skimmer 236 and the out-pool skimmer 236 is in fluid communication with the vacuum 220 via conduit 232F connected to the bottom end of skimmer 236. In an embodiment, the device 214 may be connected to the skimmer 238 via either conduits 232C or 232E and the skimmer 238 may be in fluid communication with the skimmer 236 via conduit 236G with the skimmer 236 being in fluid communication with the vacuum 220 via conduit 232B. In an embodiment, the device 214 may be in fluid communication with the simmer 236 via the conduit 232A and the skimmer 36 may be in fluid communication with the skimmer 238 via conduit 232G; with the skimmer 238 being in fluid communication with the vacuum 220 via either one of conduits 232D or 232F. The conduit 232G may be connected to either the top or bottom ends of skimmer 238.

Of course, the foregoing and other assembly permutations can be contemplated by the skilled artisan within the scope of the present disclosure.

Figure 23:
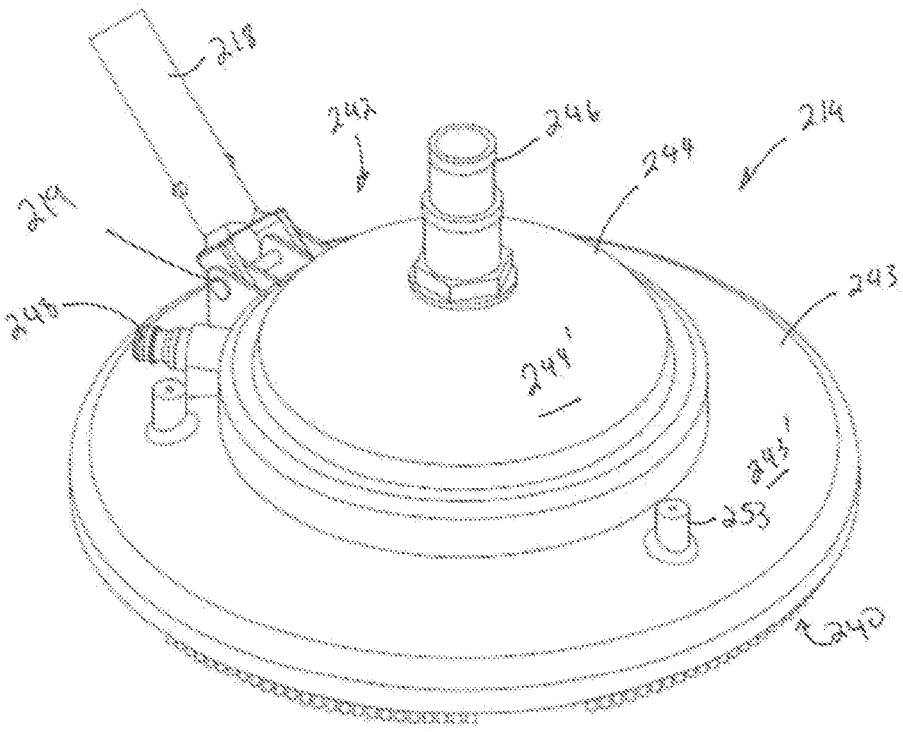
FIG. 23 is a top and front perspective view of the vacuum head of the assembly of FIG. 22 in accordance with a non-restrictive illustrative embodiment of the present disclosure.
Figure 24:
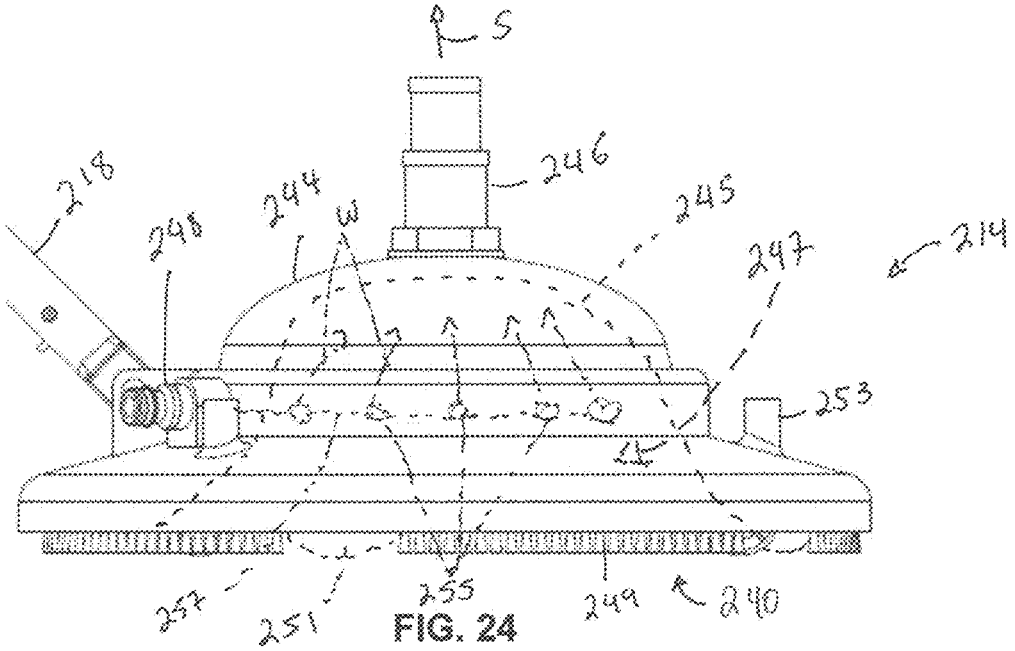
FIG. 24 is a side view of the vacuum head of FIG. 22.
Figure 25:
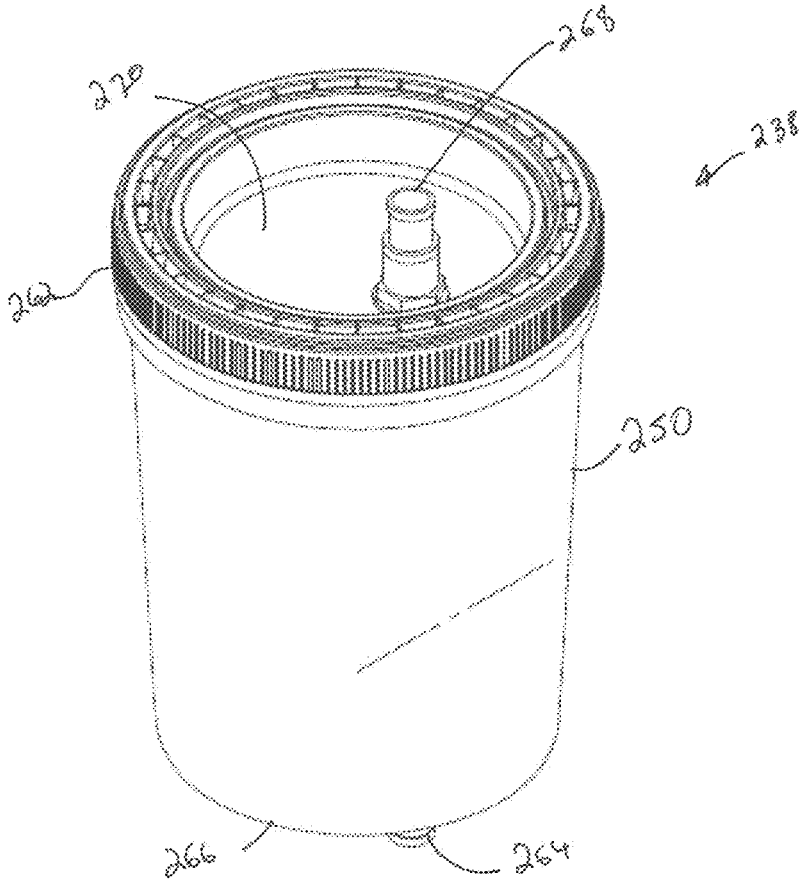
FIG. 25 is a top and front perspective view of a skimmer of the assembly of FIG. 22 in accordance with a non-restrictive illustrative embodiment of the present disclosure.
Figure 26:
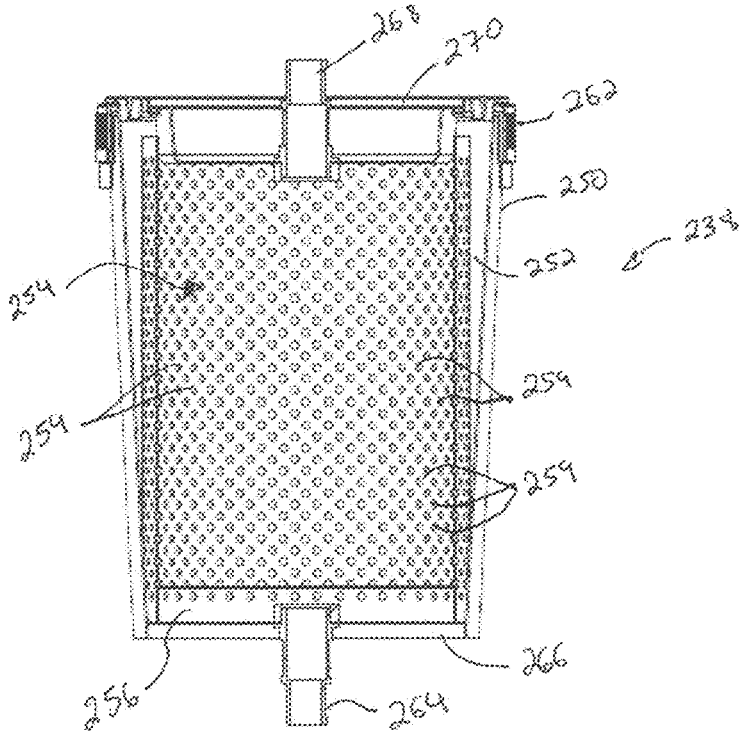
FIG. 26 is a sectional view of the skimmer of FIG. 25.
Figure 27:
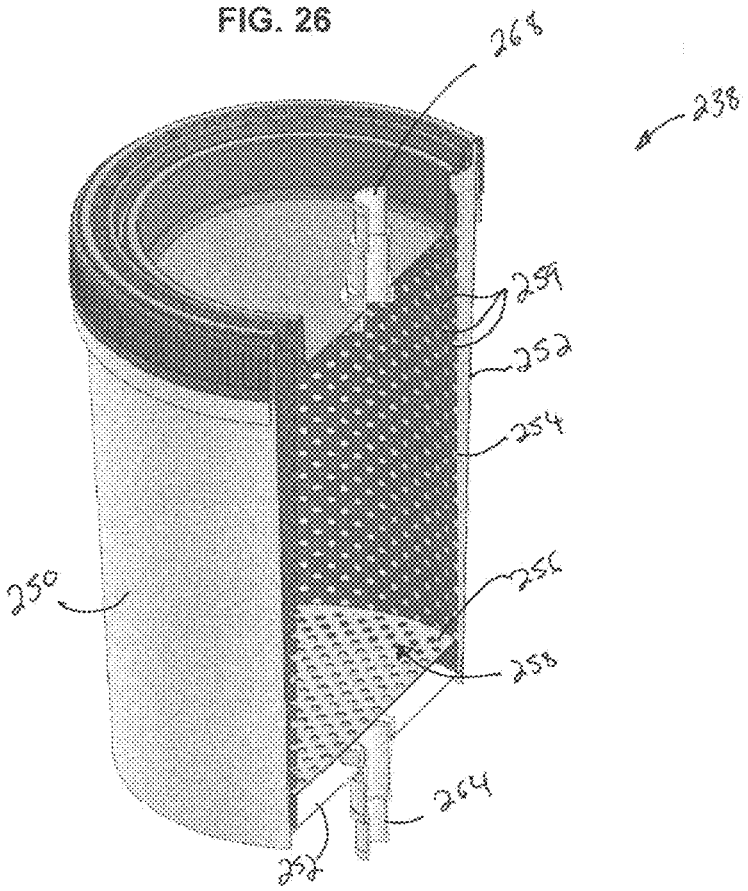
FIG. 27 is perspective sectional view of the skimmer of FIG. 25.
Figure 28:
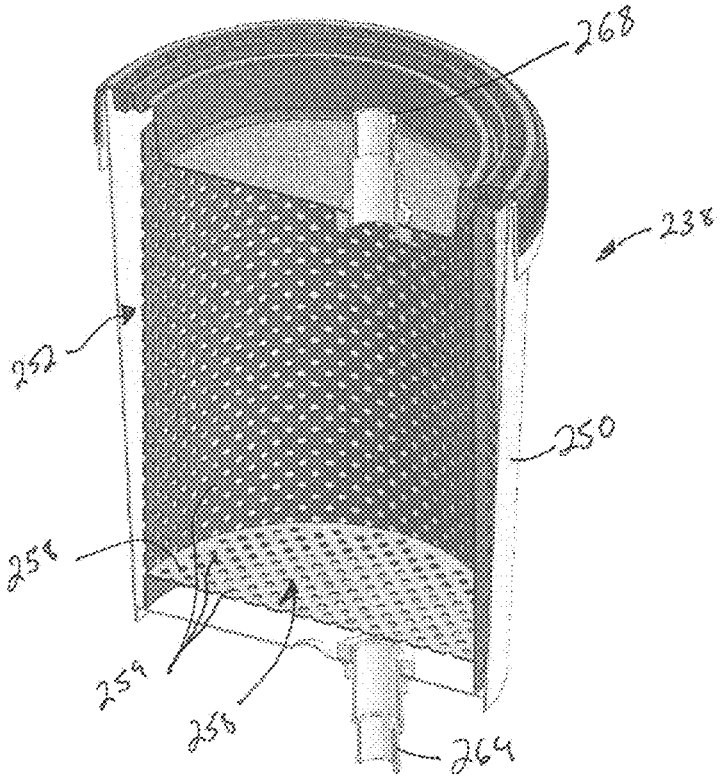
FIG. 28 is another perspective sectional view of the skimmer of FIG. 27.

Turning now to FIGS. 23 and 24, the vacuum head device 214 is shown comprising a sweeping side 240 and a non-sweeping side 242.

More specifically, the head 214 includes a bottom plate 243 defining the sweeping side 40. An upper plate 244 is mounted to the bottom plate 243. The outer surface 244' upper portion plate 244 and the upper surface 243' of the bottom plate 243 generally define the non-sweeping side 242. The inner surface 245 of the plates 243 and 244 define a mouth cavity 247 for receiving leaves and debris therein.

Plate 243 includes brushes 249 circumscribing the mouth cavity 247 as well as swivel wheels 251 mounted to swivel supports 253 to roll on the bottom pool surface 216 while brushing the surface.

Plate 244 includes an outlet port 246 in fluid communication with the mouth cavity 247. In the example shown here outlet port 46 is a top vertical port. Outlet 246 is in fluid communication with the vacuum 220 via the conduit assembly 232 and the skimmer assembly 234 as previously described for creating a vacuum force within the mouth cavity 247.

Plate 244 also includes an inlet port 428 in fluid communication with the mouth cavity 247. In the example shown here inlet port 246 is a lateral horizontal port. Inlet port 248 is in fluid communication with the water source 228 via the conduit 230 to receive water into the mouth cavity 247. The inlet port 246 leads to internal nozzles 255 circumscribing the mouth cavity 247 for shooting pressurized water W inside the mouth cavity 247. The internal nozzles 255 are interconnected via conduit 257 which is in fluid communication with the inlet port 248. This pressurized water causes turbulence within the mouth cavity 247 in tandem with the vacuum force show suctioning the water with leaves and debris in the direction shown by arrow S. In an embodiment, the nozzles 255 shoot water upwardly towards the direction of the outlet port 246.

The vacuum force along with the water pressure provides for suctioning water, leaves and debris at a faster rate and greater volume for discharge via outlet 246 thereby minimizing the pool cleaning process time.

In an embodiment, the handle 218 is pivotally connected to the vacuum head device 214 via a pivot connection 219.

In an embodiment, the outlet port 246 swivels about the plate 244. In an embodiment, the plate 244 swivels about the plate 243. The foregoing swivel connections can be provided by a variety of ways known in the art.

The skilled artisan can contemplate various shapes, configurations and structures of the vacuum head device 214, within the scope of the present disclosure, and thus can provide other suitable locations and positions of ports 246 and 248 as well as a greater number of such ports and various levels of suctioning and/or vacuuming forces.

FIGS. 25 to 28 show the skimmer 238 in accordance with an embodiment. The skimmer 238 includes an outer housing shell 250 defining a housing cavity 252 for housing therein a removable basket 254. The removable basket 254 comprises a rigid shell body 256 defining a basket receiving area 258. The rigid shell body 256 comprises apertures 259 for providing fluid communication between the housing cavity 254 and the basket receiving area 258. A removable top cover 262 provides access to the cavity 252 and basket 254 for removal and cleaning thereof. The outer housing shell 250 includes a bottom port 264 at the bottom undersurface 266 thereof and a top port 268 at the top surface 270 thereof defined by the top cover 262. Top port 268 is a direct conduit into the basket receiving area 258 and therefore functions as an inlet port for water intake via conduit assembly 232. The bottom port 264 is a direct conduit into the cavity 252 and receives strained water from the basket 254. The basket 254 thus entraps leaves and debris vacuumed by the vacuum head device 214 via conduit assembly 232, the strained water is discharged from the skimmer 238 via the port 264 towards the vacuum 220 via the conduit assembly 232. Of course, the skilled artisan can contemplate the top port 268 being the outlet and the bottom port 264 being the inlet port. In the foregoing example, the skimmer 238 receives water intake from conduit assembly 232 connected to port 264 and delivers strained water to vacuum 220 via the conduit assembly 232 connected to port 268.

Figure 29:
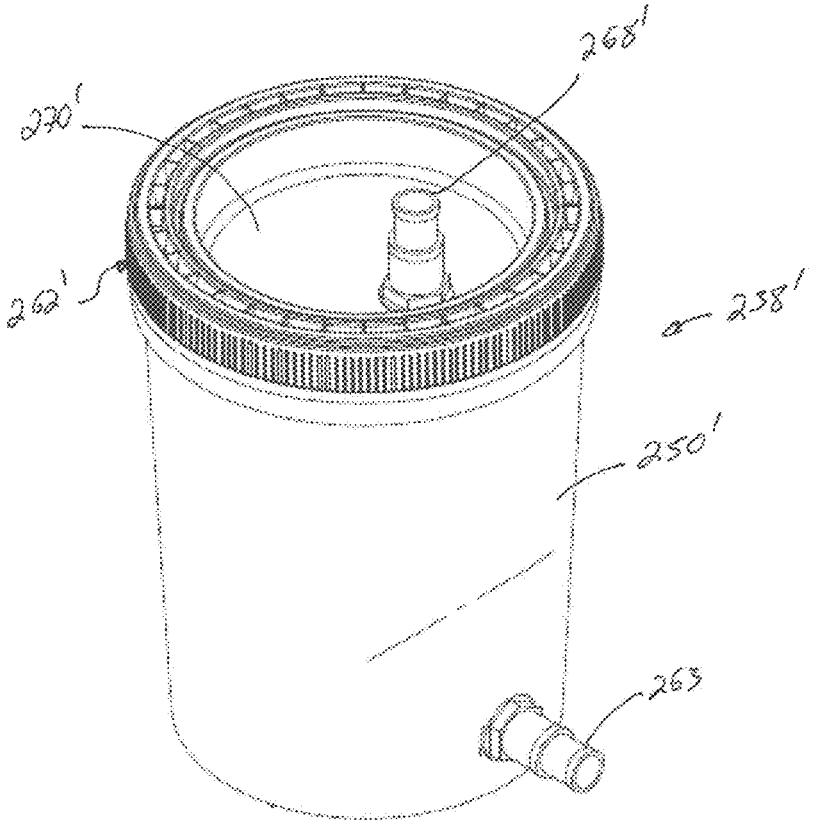
FIG. 29 is a top and front perspective view of a skimmer of the assembly of FIG. 22 in accordance with another non-restrictive illustrative embodiment of the present disclosure.
Figure 30:
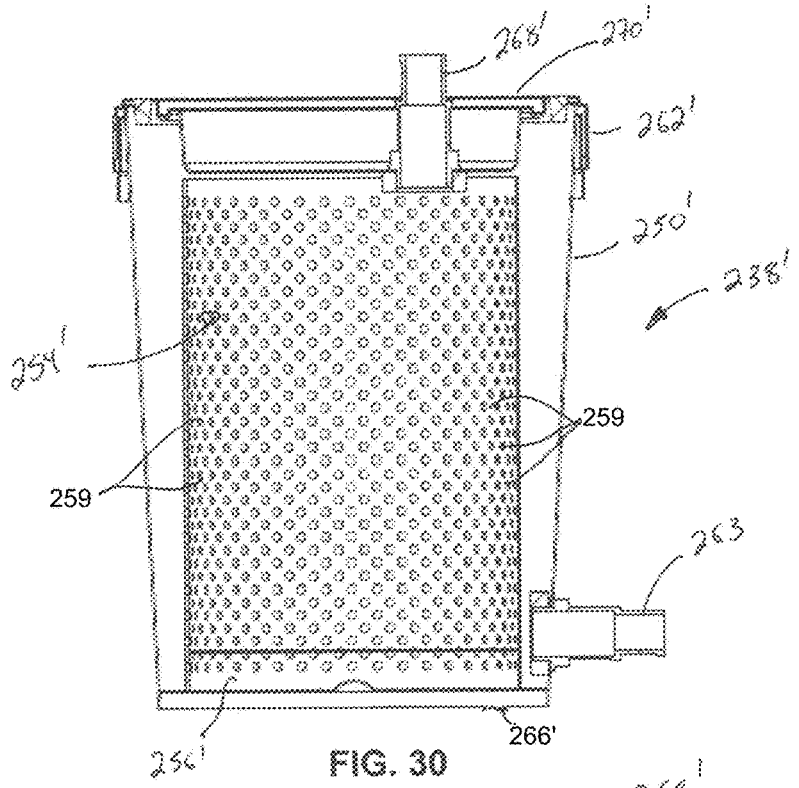
FIG. 30 is a sectional view of the skimmer of FIG. 29.
Figure 31:
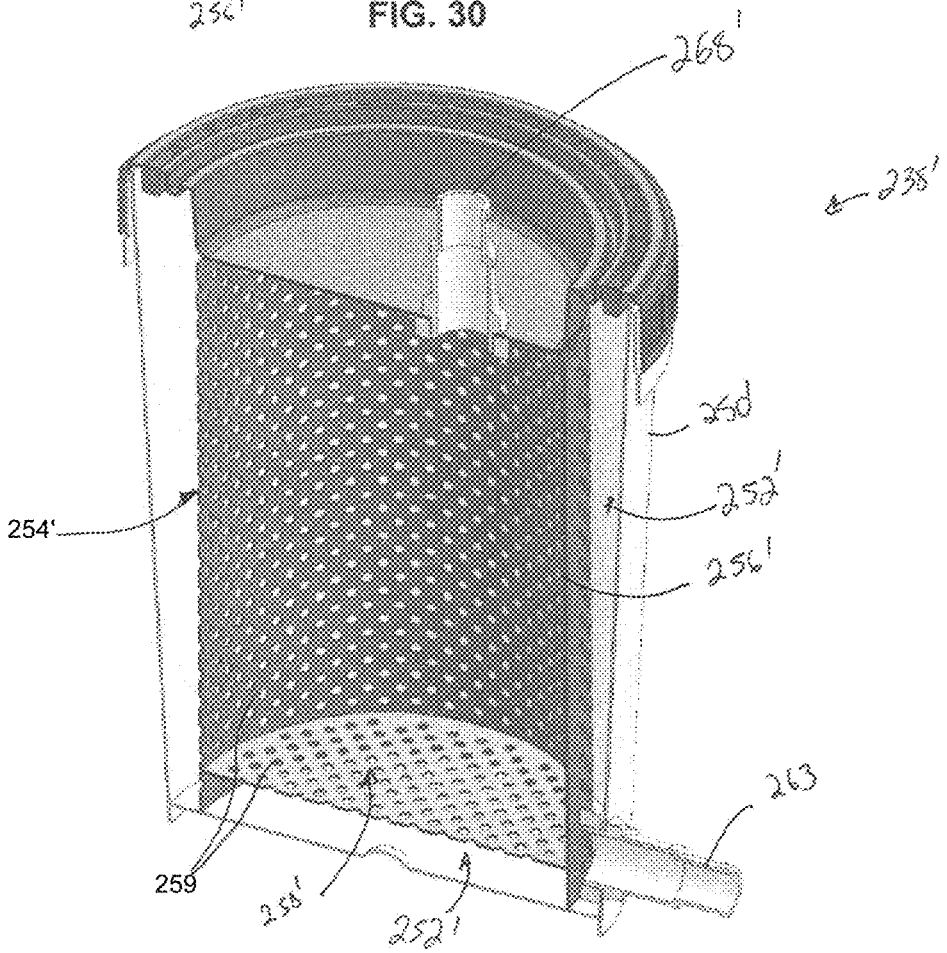
FIG. 31 is perspective sectional view of the skimmer of FIG. 29.

FIGS. 29 to 31 show the skimmer 238' in accordance with another embodiment. The skimmer 238' includes an outer housing shell 250' defining a housing cavity 252' for housing therein a removable basket 254'. The removable basket 254' comprises a rigid shell body 256' defining a basket receiving area 258'. The rigid shell body 256' comprises apertures 259. for providing fluid communication between the housing cavity 254' and the basket receiving area 258. A removable top cover 262' provides access to the cavity 252' and basket 254' for removal and cleaning thereof. The outer housing shell 250' includes a lower lateral port 263 near bottom undersurface 266' thereof and a top port 268' at the top surface 270' thereof defined by the top cover 262'. Top port 268' is a direct conduit into the basket receiving area 258' and therefore functions as an inlet port for water intake via the conduit assembly 232. The lower lateral port 263 is a direct conduit into the cavity 252' and receives strained water from the basket 254'. The basket 254' thus entraps leaves and debris vacuumed by the vacuum head device 214 via the conduit assembly 232, the strained water is discharged from the skimmer 238' via the port 263 towards the vacuum 220 via the conduit assembly 232. Of course, the skilled artisan can contemplate the top port 268 being the outlet and the lower port 263 being the inlet port. In the foregoing example, the skimmer 238' receives water intake from the conduit assembly 232 connected to port 263 and delivers strained water to the vacuum 220 via the conduit assembly 232 connected to port 268.

The entrapped leaves and debris in baskets 254 or 254' are emptied therefrom by their respective as explained above.

Of course, lateral skimmers can also be contemplated within the scope of the present disclosure.

Figure 32:
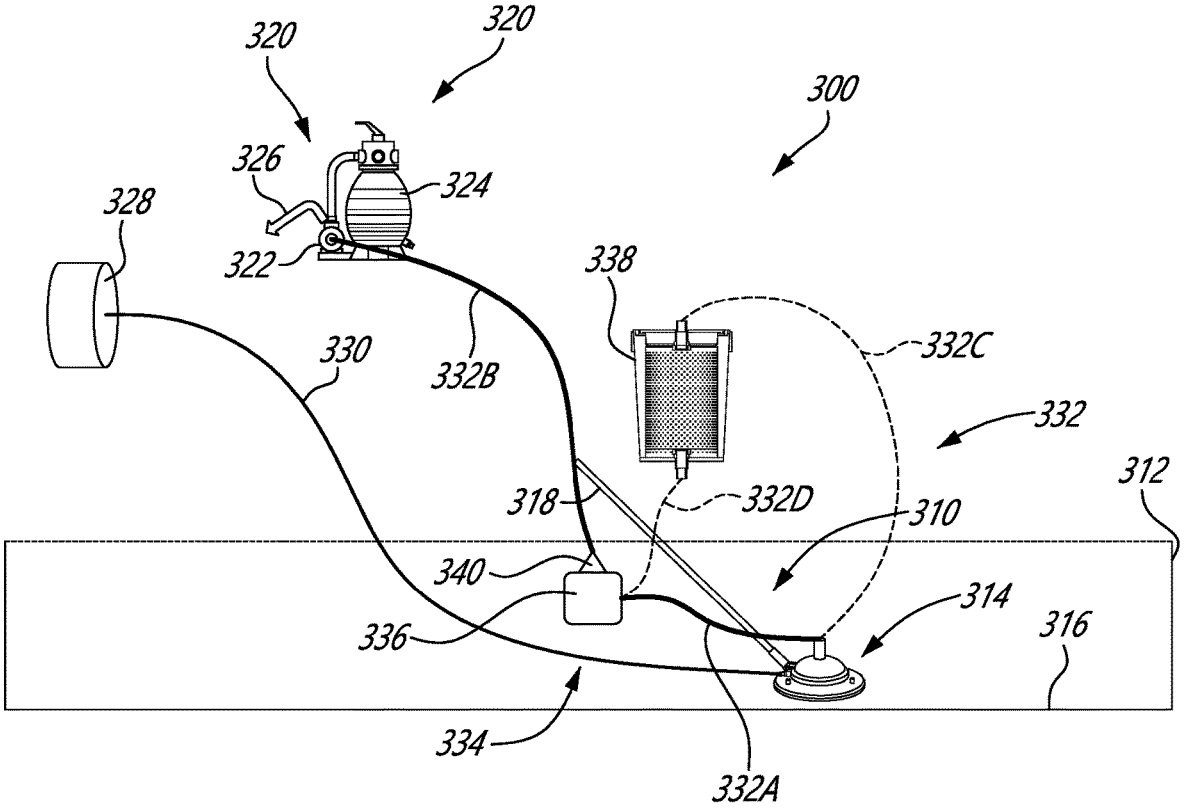
FIG. 32 is a schematic representation of an assembly cleaning a swimming pool in accordance with a furthernon-restrictive illustrative embodiment of the present disclosure.

FIG. 32 shows an assembly 300 for cleaning swimming pools 312 in accordance with a non-limiting illustrative embodiment of the present disclosure.

The assembly 300 includes a vacuuming device 310 for cleaning pools 312 which comprises a vacuum head device 314 that is used to sweep a bottom surface 316 of the swimming pool 312. The vacuum head device 314 is maneuvered along the bottom surface 316 by way of a handheld rod 318. The vacuum head device 132 is in fluid communication with a vacuum 320 such as a pump. The pump 320 may a single device or comprise an assembly including a pump unit 322 and a filter 324 such as a sand filter. The pump 320 includes an outlet conduit 326 for discarding pool water into sewage.

The vacuum head device 314 is in fluid communication with a water source 328 via a conduit 330 for providing water to the vacuum head device 314.

The vacuum head device 314 is in fluid communication with the vacuum 320 via a conduit assembly 332 which includes a skimmer assembly 334. The skimmer assembly 334 comprises a skimmer 336 and optionally a pre-filter 338.

The conduit assembly 332 may be connected directly to the pump unit 322 or to a filter 324 for example.

The conduit assembly 332 may comprise a plurality of various conduit connections via the skimmer assembly 334 to the vacuum 320.

In an embodiment, the device 314 is in fluid communication with the skimmer 336 via conduit 332A, the skimmer 336 is in fluid communication with the vacuum 320 via conduit 332B.

In an embodiment, the device 314 is in fluid communication with the pre-filter 338 via conduit 332C which is connected to a top end of the pre-filter 338. The pre-filter 338 is connected via its bottom end to the skimmer 336 by way of conduit 332D.

Of course, the foregoing and other assembly permutations can be contemplated by the skilled artisan within the scope of the present disclosure.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A device for cleaning a swimming pool, the swimming pool containing water and comprising a bottom surface thereof, the device comprising:

a vacuum head defining a sweeping side, an inlet port, an outlet port and an internal cavity in fluid communication with the inlet and outlet ports, the sweeping side providing for being swept along the bottom surface of the swimming pool and defining an opening leading to the internal cavity, the outlet port providing for being in fluid communication with a vacuum for subjecting the internal cavity to a vacuum force for suctioning water and debris, the inlet port providing for being in fluid communication with a water source for injecting water into the internal cavity during suctioning, wherein the vacuum force via the outlet port in tandem with water injection via the inlet port provides for the vacuum head to suction water and debris via the opening for discharge via the outlet port, wherein the vacuum head comprises a bottom plate defining the inlet port and comprising a conduit and an upper plate defining the outlet port.

2. A device according to claim 1, wherein the upper plate is mounted to the bottom plate.

3. A device according to claim 2, wherein the upper plate is removable from the bottom plate.

4. A device according to claim 1, further comprising a suction hose for being connected to the outlet port and to a skimmer in fluid communication with the vacuum.

5. A device according to claim 4, further comprising a vacuum plate for being connected to the suction hose and to the skimmer.

6. A device according to claim 5, wherein the vacuum plate comprises a port for being connected to the suction hose and a release valve for being selectively opened and closed.

7. A device according to claim 4, further comprising at least one cap member for closing an open end of the suction hose when removed from the skimmer or from the vacuum head.

8. A device according to claim 1, further comprising a water hose for being connected to inlet port of the vacuum head and to the water source.

9. An assembly for cleaning a swimming pool comprising:

a device for cleaning a swimming pool according to claim 1; and a skimmer assembly in fluid communication with the vacuum head via the outlet port and with the vacuum for being subjected to the vacuum force, wherein the vacuum force via the outlet port in tandem with water injection via the inlet port provides for the vacuum head to suction water and debris via the opening for discharge via the outlet port and into the skimmer assembly.

10. An assembly according to claim 9, wherein the skimmer assembly is selected from the group consisting of an in-ground pool skimmer, an out-pool skimmer, two in-ground pool skimmers, two out-pool skimmers, an in-ground pool skimmer connected to an out-pool skimmer and any combination thereof.

11. A device according to claim 1, wherein the vacuum head comprises a conduit circumscribing the internal cavity and being in fluid communication with the inlet port, the conduit defining openings for injecting water received from the water source via the inlet port into the cavity.

12. A device according to claim 1 further comprising a handle mounted to the vacuum head for maneuvering the vacuum head along the bottom surface of the swimming pool.

13. A device according to claim 11, wherein the openings are defined by water injection elements connected to the conduit.

14. A device according to claim 4, wherein the water injection elements are selected from the group consisting of nozzles and jets.

15. A device for cleaning a swimming pool, the swimming pool containing water and comprising a bottom surface thereof, the device comprising:

a bottom plate for being mounted to a vacuum head defining an outlet portion, the bottom plate defining a sweeping side, an inlet port, and an internal cavity in fluid communication with the inlet port and for being placed in fluid communication with the outlet port, the sweeping side providing for being swept along the bottom surface of the swimming pool and defining an opening leading to the internal cavity, the outlet port providing for being in fluid communication with a vacuum for subjecting the internal cavity to a vacuum force for suctioning water and debris, the inlet port providing for being in fluid communication with a water source for injecting water into the inner cavity during suctioning, wherein the vacuum force via the outlet port in tandem with water injection via the inlet port provides for the vacuum head to suction water and debris via the opening for discharge via the outlet port.

* * * * *